US009115607B2

(12) United States Patent
Harman

(10) Patent No.: US 9,115,607 B2
(45) **Date of Patent: *Aug. 25, 2015**

(54) PIVOT FOOT FOR DEACTIVATING ROCKER ARM

(71) Applicant: Eaton Corporation, Cleveland, OH (US)

(72) Inventor: Andrew Paul Harman, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/097,589

(22) Filed: Dec. 5, 2013

(65) Prior Publication Data

US 2014/0116366 A1 May 1, 2014

Related U.S. Application Data

(63) Continuation of application No. 13/091,451, filed on Apr. 21, 2011, now Pat. No. 8,627,796.

(51) Int. Cl.

| | |
|---|---|
| ***F01L 1/18*** | (2006.01) |
| ***F01L 1/46*** | (2006.01) |
| ***F01L 13/00*** | (2006.01) |

(52) U.S. Cl.

CPC . *F01L 1/18* (2013.01); *F01L 1/185* (2013.01); *F01L 1/46* (2013.01); *F01L 13/0005* (2013.01)

(58) Field of Classification Search

CPC ..... F01L 1/18; F01L 1/185; F01L 2001/18; F01L 2001/186; F01L 2001/187; F01L 1/46; F01L 13/0005

USPC ..... 123/90.39, 90.44, 90.16

See application file for complete search history.

(56) References Cited

U.S. PATENT DOCUMENTS

| | | | |
|---|---|---|---|
| 4,151,817 | A | 5/1979 | Mueller |
| 4,203,397 | A | 5/1980 | Soeters |

(Continued)

FOREIGN PATENT DOCUMENTS

| | | |
|---|---|---|
| DE | 102007025182 | 12/2008 |
| DE | 102007025182 A | 12/2008 |

(Continued)

OTHER PUBLICATIONS

International Search Report and Written Opinion for International Application No. PCT/US2012/034494 dated Jul. 2, 2012.

(Continued)

*Primary Examiner* — Ching Chang

(74) *Attorney, Agent, or Firm* — Remarck Law Group PLC

(57) ABSTRACT

A dual body rocker arm comprises an outer arm, an inner arm, a substantially cylindrical pivot axle, a pivot foot and a first and second pivot foot retaining ring. The inner arm is disposed between side arms of the outer arm. The pivot axle is mounted to both the inner and outer arm. The pivot foot has a cylindrical axle interfacing surface and a valve tip interface. Retaining rings mount the pivot foot to the axle, allowing partial rotation of the pivot foot about the axle. Interfering protrusions on the retaining rings limit the range of motion of the pivot foot. A pivot foot having at least one interfering block is configured to restrict motion of the pivot foot by interfering with at least one interfering tab.

20 Claims, 6 Drawing Sheets

(56) References Cited

U.S. PATENT DOCUMENTS

| | | | | |
|---|---|---|---|---|
| 4,762,096 | A | 8/1988 | Kamm et al. | |
| 4,768,467 | A | 9/1988 | Yamada et al. | |
| 5,419,290 | A | 5/1995 | Hurr et al. | |
| 5,441,020 | A | 8/1995 | Murata et al. | |
| 5,445,116 | A | 8/1995 | Hara | |
| 5,529,033 | A | 6/1996 | Hampton | |
| 6,325,030 | B1 | 12/2001 | Spath et al. | |
| 6,467,445 | B1 | 10/2002 | Harris | |
| 6,532,920 | B1 | 3/2003 | Sweetnam et al. | |
| 6,769,387 | B2 | 8/2004 | Hayman et al. | |
| 6,837,197 | B2 | 1/2005 | Cecur | |
| 6,976,461 | B2 | 12/2005 | Roerig et al. | |
| 6,997,152 | B2 | 2/2006 | Harris | |
| 7,185,619 | B2 | 3/2007 | Motohashi | |
| 7,546,822 | B2 | 6/2009 | Murphy et al. | |
| 7,712,443 | B2 | 5/2010 | Gemein | |
| 7,909,007 | B2 | 3/2011 | Manther et al. | |
| 7,926,455 | B2 | 4/2011 | Manther et al. | |
| 8,132,551 | B2 | 3/2012 | Manther | |
| 8,251,032 | B2 | 8/2012 | Manther | |
| 8,267,059 | B2 | 9/2012 | Manther et al. | |
| 8,312,851 | B2 | 11/2012 | Heinemann | |
| 8,375,909 | B2 | 2/2013 | Radulescu et al. | |
| 8,393,308 | B2 | 3/2013 | Kang et al. | |
| 8,627,796 | B2 * | 1/2014 | Harman | 123/90.44 |
| 2001/0023672 | A1 | 9/2001 | Cecur | |
| 2002/0017253 | A1 | 2/2002 | Danesh et al. | |
| 2004/0045518 | A1 | 3/2004 | Abe | |
| 2004/0074459 | A1 | 4/2004 | Hayman et al. | |
| 2004/0182340 | A1 | 9/2004 | Cecur | |
| 2005/0092273 | A1 | 5/2005 | Cecur et al. | |
| 2007/0000460 | A1 | 1/2007 | Roerig et al. | |
| 2007/0006837 | A1 | 1/2007 | Seitz et al. | |
| 2008/0190389 | A1 | 8/2008 | Rozario et al. | |
| 2008/0245330 | A1 | 10/2008 | Deierlein et al. | |
| 2010/0083922 | A1 | 4/2010 | Riley | |
| 2010/0300389 | A1 | 12/2010 | Manther et al. | |
| 2011/0030634 | A1 | 2/2011 | Palumbo | |
| 2011/0197842 | A1 | 8/2011 | Manther et al. | |
| 2012/0266835 | A1 | 10/2012 | Harman | |
| 2013/0000582 | A1 | 1/2013 | Church | |

FOREIGN PATENT DOCUMENTS

| | | |
|---|---|---|
| DE | 102009041367 | 3/2011 |
| DE | 102009041367 A | 3/2011 |
| JP | 2009503345 | 1/2009 |
| JP | 2009516806 | 4/2009 |
| JP | 2012041928 | 3/2012 |

OTHER PUBLICATIONS

European Office Action for European Application No. 12719178.1 dated Dec. 13, 2013.

Japanese Office Action dated Apr. 9, 2014 for Japanese Patent Application No. 2014-506583 (6 pages).

* cited by examiner

PIVOT FOOT FOR DEACTIVATING ROCKER ARM

CROSS-REFERENCE TO RELATED APPLICATIONS

This application is a continuation of U.S. patent application Ser. No. 13/091,451 filed on Apr. 21, 2011. The disclosure of the above application is incorporated herein by reference.

FIELD OF THE INVENTION

This application is directed to pivot feet of deactivating rocker arms for internal combustion engines.

BACKGROUND

Many internal combustion engines utilize rocker arms to transfer rotational motion of cams to linear motion appropriate for opening and closing engine valves. Integration of rocker arms with the rest of the valve train, for example the valve tip, is necessary, and features that assist in such integration are advantageous.

SUMMARY

A dual body rocker arm according to one example of the present disclosure can include a first end, a second end, an outer arm, an inner arm, a substantially cylindrical pivot axle, a pivot foot, and a first and a second pivot foot retaining ring. The outer arm can include a first and a second outer side arm extending from the first end to the second end. Outer pivot axle apertures can be disposed adjacent to the first end and can be configured for mounting the pivot axle. The inner arm can be disposed between the first and second outer side arms and can include a first and a second inner side arm. The first and second inner side arms can have inner pivot axle apertures disposed adjacent to the first end and configured for mounting the pivot axle. The pivot axle can be disposed in the inner pivot axle apertures and the outer pivot axle apertures. The pivot foot can have (i) a cylindrical axle interfacing surface extending between the first and second inner side arms, (ii) a first and a second retaining ring mounting portion. The first retaining ring mounting portion can be disposed between the valve tip interface and the first inner side arm. The second retaining ring mounting portion can be disposed between the valve tip interface and the second inner side arm. The first and second retaining rings can overlap the corresponding first and second retaining ring mounting portions and partially rotatably mount the pivot foot to the pivot axle. At least one of the first and second retaining rings can have a first interfering protrusion configured to permit movement of at least one of the first and second retaining rings relative to the inner arm until the first interfering protrusion contacts an interfering projection disposed on the inner arm.

According to additional features at least one of the first and second retaining rings can include a second interfering protrusion separated from the first interfering protrusion by a projection gap. The interfering projection can extend from at least one of the first inner side arm toward the second inner side arm, or the second inner side arm toward the first inner side arm. The interfering projection can be disposed adjacent a projection gap of at least one of the retaining rings and can be configured to limit rotation movement of at least one of the retaining rings about the pivot axle. The retaining ring can comprise guides extending further from a longitudinal axis of the pivot axle than a valve tip interfacing surface of the pivot foot.

According to other features, the dual rocker arm can further comprise a first axle clip recess disposed adjacent to a first end of the pivot axle, a second axle clip recess disposed adjacent a second end of the pivot axle, and an axle clip disposed within each of the first and second axle clip recesses. The first and second retaining rings can be fixed for rotation with the pivot foot.

A dual body rocker arm according to another example of the present disclosure can include a first end, a second end, an outer arm, an inner arm, a substantially cylindrical pivot axle, and a pivot foot. The outer arm can have a first and a second outer side arm extending from the first end to the second end, and outer pivot axle apertures disposed adjacent to the first end and configured for mounting the pivot axle. The inner arm can be disposed between the first and second outer side arms and have a first and a second inner side arm. The first and second inner side arms can have inner pivot axle apertures disposed adjacent to the first end and configured for mounting the pivot axle. The first inner side arm can have a first interfering tab adjacent to the first end and extending toward the second inner side arm. The second inner side arm can have a second interfering tab adjacent the first end and extending toward the first inner side arm. The pivot axle can be disposed in the inner pivot axle apertures and the outer pivot axle apertures. The pivot foot can have (i) a cylindrical axle interfacing surface, (ii) a valve tip interface, and (iii) at least one interfering block, wherein the at least one interfering block can rotate with the pivot foot relative to the first and second interfering tabs. Contact of the at least one interfering block with one of the first and second interfering tabs can restrict further relative movement of the pivot foot and the inner and outer side arms.

According to other features, the at least one interfering block can comprise first and second interfering blocks. The first interfering block can be disposed between the valve tip interface and the first inner side arm. The second interfering block can be disposed between the valve tip interface and the second inner side arm. The at least one interfering block can be configured to dispose the pivot foot approximately between the pivot axle and the interfering tabs. The interfering tabs can be configured to restrict movement of the valve tip relative to the pivot foot.

According to additional features the dual rocker arm can further include a first axle clip recess disposed adjacent a first end of the pivot axle, a second axle clip recess disposed adjacent a second end of the pivot axle. An axle clip can be disposed within each of the first and second axle clip recesses. The valve tip interface can be disposed between the first and second inner side arms. The at least one interfering block can be disposed between the valve tip interface and one of the first inner side arm and the second inner side arm.

A dual body rocker arm according to another example of the present disclosure can include a first end, a second end, an outer arm, an inner arm, a substantially cylindrical pivot axle, and a pivot foot that rotates relative to the inner arm. The pivot foot can have an axle interfacing surface, a block and a valve tip interface. The outer arm can have a first and a second outer side arm extending from the first end to the second end and outer pivot axle apertures disposed adjacent the first end and configured for mounting the pivot axle. The inner arm can be disposed between the first and second outer side arms and have a first and a second inner side arm. The first and second inner side arms can have inner pivot axle apertures disposed adjacent the first end and configured for mounting the pivot axle. The pivot axle can be disposed in the inner pivot axle apertures and the outer pivot axle apertures. At least one interfering projection can extend from at least one of the first inner side arm toward the second inner side arm, or the second inner side arm toward the first inner side arm. At least one interfering tab can extend from the first inner side arm toward the second inner side arm or the second inner side arm toward the first inner side arm. The block engages the at least one interfering tab upon rotation of the pivot foot relative to the inner arm causing further rotation of the pivot foot relative to the inner arm to be precluded.

According to additional features the pivot foot can include (i) a cylindrical axle interfacing surface and (ii) a valve tip interface. The cylindrical axle interfacing surface can extend between the first and second inner side arms. The valve tip interface can be disposed between the first and second inner side arms. The dual body rocker arm can further include a first axle clip recess disposed adjacent a first end of the pivot axle, and a second axle clip recess disposed adjacent a second end of the pivot axle. An axle clip can be disposed within each of the first and second axle clip recesses.

comprises an outer arm, an inner arm, a substantially cylindrical pivot axle, a pivot foot and a first and second pivot foot retaining ring. The outer arm and inner arm each have a first and second side arm. The inner arm is disposed between side arms of the outer arm. A pivot axle is mounted in apertures at one end of both the inner and outer arm. The pivot foot has a cylindrical axle interfacing surface and a valve tip interface. Retaining rings mount the pivot foot to the axle, allowing partial rotation of the pivot foot about the axle. Interfering protrusions on the retaining rings interfere with interfering projections located on one or both of the inner arms, limiting the range of motion of the pivot foot.

In another embodiment, a dual body rocker arm comprises an outer arm, an inner arm having at least one interfering tab, a substantially cylindrical pivot axle and a pivot foot having at least one interfering block configured to restrict motion of the pivot foot by interfering with at least one interfering tab.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Certain terminology will be used in the following description for convenience in describing the figures and will not be limiting. The terms "upward," "downward," and other directional terms used herein will be understood to have their normal meanings and will refer to those directions as the figures are normally viewed.

Figure 1:
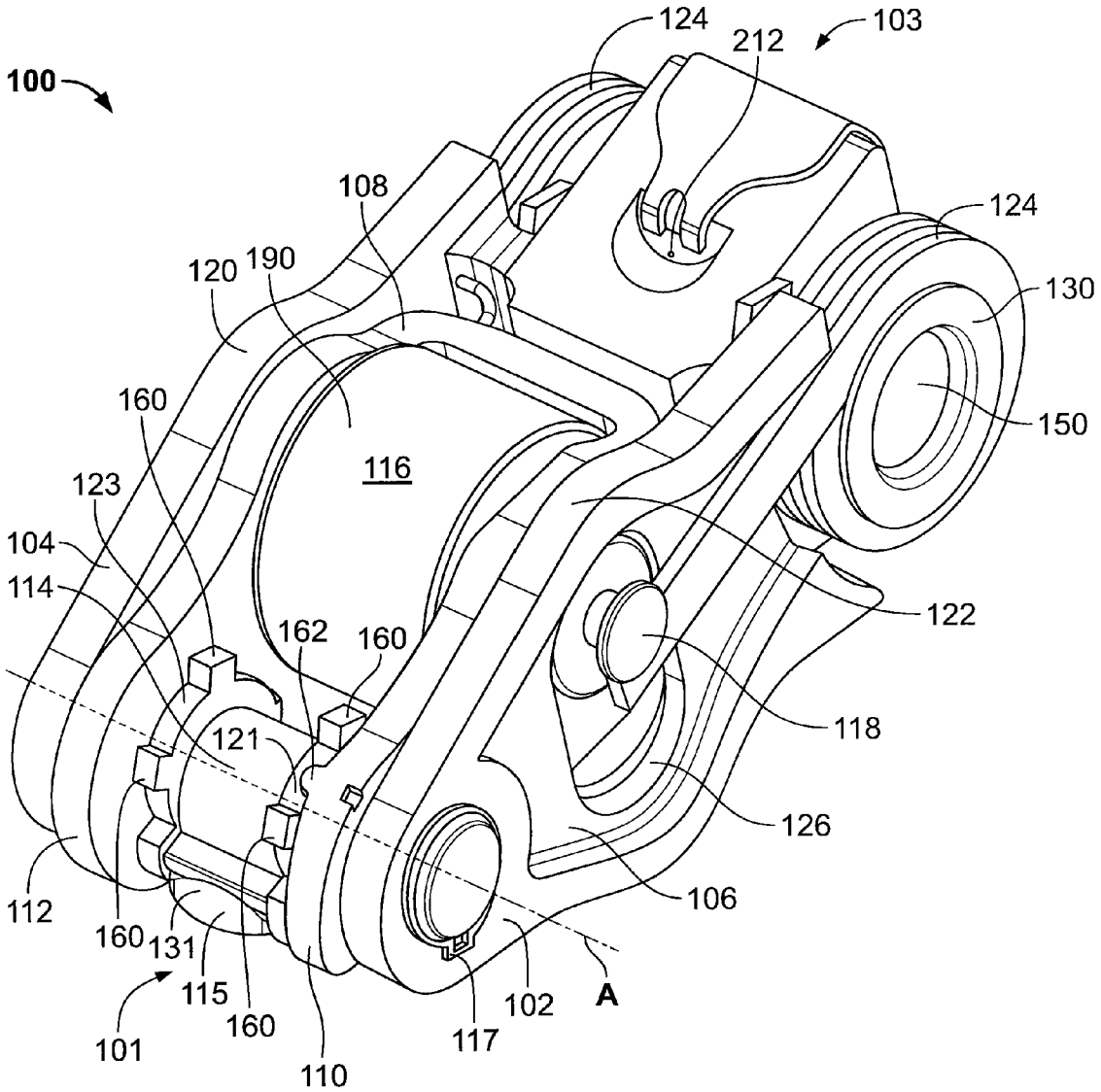
FIG. 1 illustrates a perspective view of an exemplary rocker arm 100 incorporating pivot foot 115.
Figure 2:
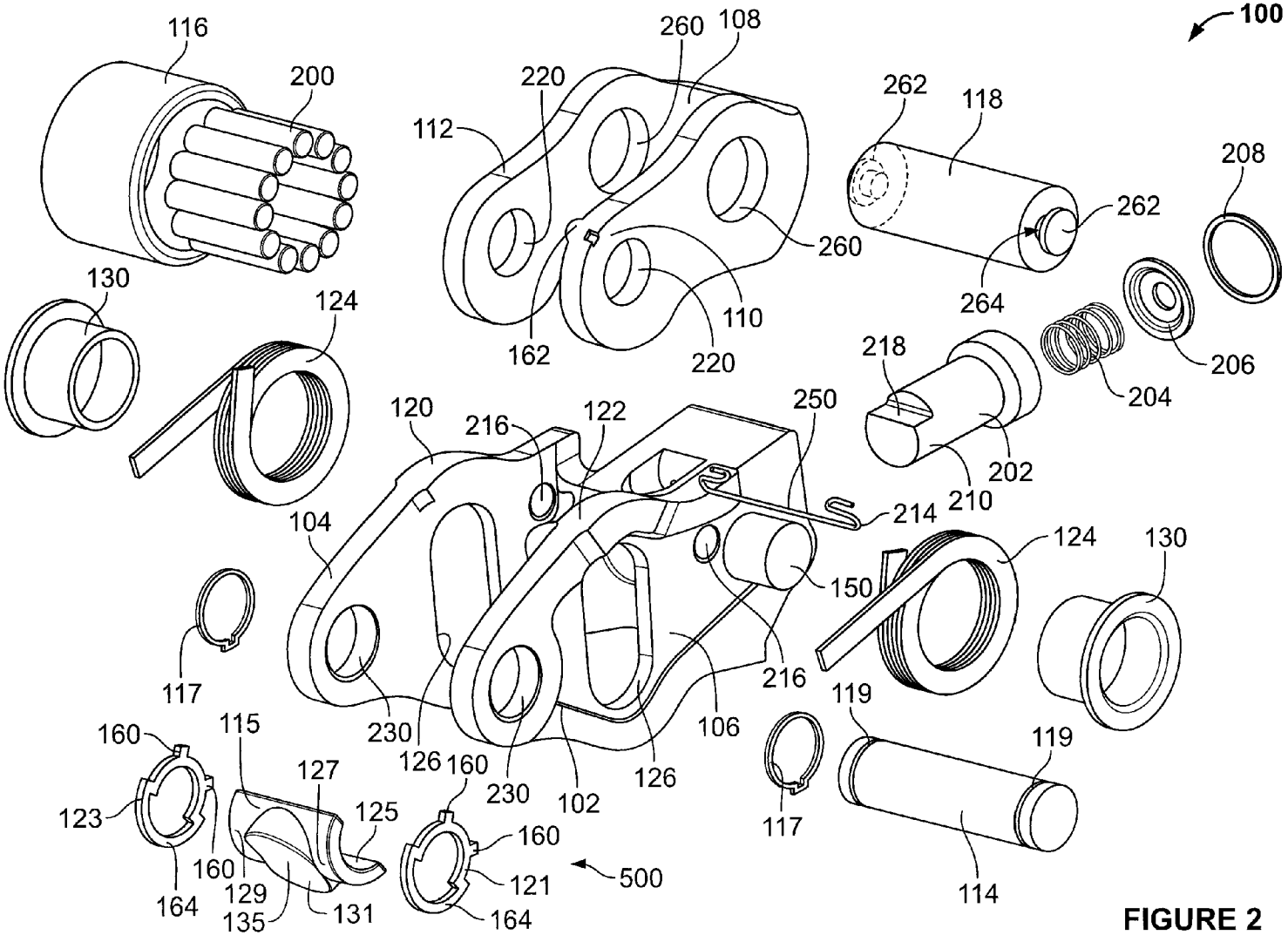
FIG. 2 illustrates an exploded view of exemplary rocker arm 100 incorporating pivot foot 115 shown in FIG. 1.

FIGS. 1 and 2 illustrate a perspective view and exploded view, respectively, of an exemplary deactivating rocker arm 100. Deactivating rocker arm 100 is shown by way of example only and it will be appreciated that the configuration of deactivating rocker arm 100 that is the subject of this disclosure is not limited to the configuration of deactivating rocker arm 100 illustrated in the figures shown herein.

As shown in FIGS. 1 and 2, deactivating rocker arm 100 includes an outer arm 102 having a first outer side arm 104 and a second outer side arm 106. An inner arm 108 is disposed between first outer side arm 104 and second outer side arm 106. Inner arm 108 has a first inner side arm 110 and a second inner side arm 112. Inner arm 108 and outer arm 102 are both mounted to a substantially cylindrical pivot axle 114, located adjacent first end 101 of rocker arm 100, which restricts motion of inner arm 108 relative to outer arm 102 to rotational motion about a longitudinal axis A of pivot axle 114. When in its deactivated state, deactivating rocker arm 100 exhibits a rotational movement of inner arm 108 relative to outer arm 102. Pivot axle 114 is secured in place relative to inner arm 108 and outer arm 102 by axle clips 117 inserted into recesses 119 in pivot axle 114. Axle clips 117 are biased to fit securely to the contour of recesses 119 and prevent motion of axle 114 along longitudinal axis A. In the illustrated embodiment, pivot axle 114 is mounted in inner pivot axle apertures 220 and outer pivot axle apertures 230 adjacent the first end 101 of rocker arm 100. Spacing between recesses 119 is chosen so that when axle clips 117 are placed in recesses 119, axle clips 117 also contact outer arm 102 and thereby prevent motion of pivot axle 114 with respect to outer arm 102 and inner arm 108 along axis A. As used herein, "radially" denotes a direction of a line intersecting A at a point and lying in a plane perpendicular to A. The term "radially outward" defines the radial direction pointing away from axis A. Conversely, "radially inward" defines the radial direction pointing toward axis A.

Figure 3:
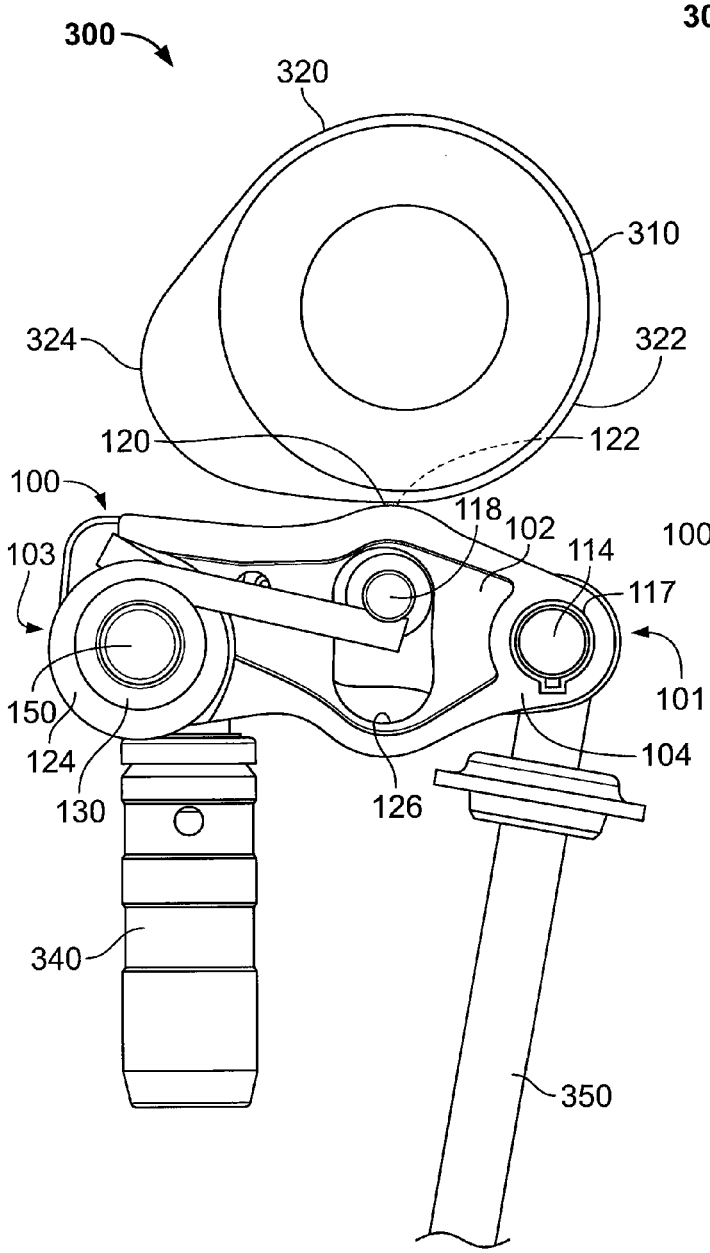
FIG. 3 illustrates a side view of deactivating rocker arm 100 in relation to a cam 300, lash adjuster 340 and valve stem 350.

When rocker arm 100 in the deactivated state, inner arm 108 pivots downwardly relative to outer arm 102 when lifting portion 324 of cam 300 (as shown in FIG. 3) comes into contact with roller 116 of bearing 190, thereby pressing it downward. Axle slots 126 allow for downward movement of bearing axle 118, and therefore of inner arm 108 and bearing 190. As cam 300 continues to rotate, lifting portion 324 of cam 300 rotates away from roller 116 of bearing 190, allowing bearing 190 to move upwardly as bearing axle 118 is biased upwardly by bearing axle springs 124. The illustrated bearing axle springs 124 are torsion springs secured to mounts 150 located on outer arm 102 by spring retainers 130. Bearing axle springs 124 are secured adjacent second end 103 of rocker arm 100 and have spring arms that come into contact with bearing axle 118. As bearing axle 118 and spring arm move downward, bearing axle 118 slides along spring arm. Knob 262 extends from the end of bearing axle 118 and creates a slot 264 in which spring arm sits.

With reference to FIGS. 1 and 2, pivot foot 115 is mounted on pivot axle 114 between first 110 and second 112 inner side arms. First and second clips 121, 123 retain pivot foot 115 against pivot axle 114. In the illustrated embodiment, clips 121, 123 are contoured rings that surround pivot axle 114. In other embodiments, clips 121, 123 need not completely surround pivot axle 114. As shown below in FIG. 6 below, pivot foot 115 has a concave cylindrical axle interfacing surface 125 extending between first and second inner side arms 110, 112. A valve tip interface 131 is disposed on the opposite side of pivot foot 115, and it features valve tip interfacing surface 135 and second clip mounting portions 127, 129. Clips 121, 123 overlap first and second clip mounting portions 127, 129 of pivot foot 115. First clip mounting portion 127 is disposed between valve tip interface surface 135 and first inner side arm 110, while second clip mounting portion 129 is disposed between valve tip interface surface 135 and second inner side arm 112.

Clips 121, 123 have interfering protrusions 160 extending radially outward relative to longitudinal axis A of axle 114. Upon rotation of clips 121, 123 about axle 114 in either direction, an interfering protrusion 160 will come into contact with an interfering projection 162 extending from one of the first and second inner side arms 110, 112 to the other of first and second inner side arms 110, 112. In the illustrated case, projection 162 is on first inner side arm 110. Once in contact, interfering protrusion 160 and interfering projection 162 prevent any further rotation of clips 121, 123 in the selected direction about axis A relative to inner body 108. Clips 121, 123, however, may then be rotated in the opposite direction until contact is made between a different interfering protrusion 160 and interfering projection 162.

The mechanism for selectively deactivating rocker arm 100, which in the illustrated embodiment is found near second end 103 of rocker arm 100, is shown in FIG. 2 as comprising latch 202, latch spring 204, spring retainer 206 and clip 208. Latch 202 is configured to be mounted inside outer arm 102. Latch spring 204 is placed inside latch 202 and secured in place by latch spring retainer 206 and clip 208. Once installed, latch spring 204 biases latch 202 toward first end 101 of rocker arm 100, allowing latch 202, and in particular engaging portion 210 to engage inner arm 108, thereby preventing inner arm 108 from moving with respect to outer arm 102. When latch 202 is engaged with inner arm 108 in this way, rocker arm 100 is in the activated state, and will transfer motion from cam 300 to valve stem 350. To deactivate rocker arm 100, oil pressure sufficient to counteract the biasing force of latch spring 204 may be applied, for example, through port 212, which is configured to permit oil pressure to be applied to surface of latch 202. Oil pressure is applied, latch 202 retracts from engagement with inner arm 108, allowing inner arm 108 to rotate about pivot axle 114. In both activated and deactivated states, linear portion 250 of orientation clip 214 engages latch 202 at flat surface 218. Orientation clip 214 is mounted in clip apertures 216, thereby maintaining horizontal orientation of linear portion 250 relative to rocker arm 100.

Figure 4:
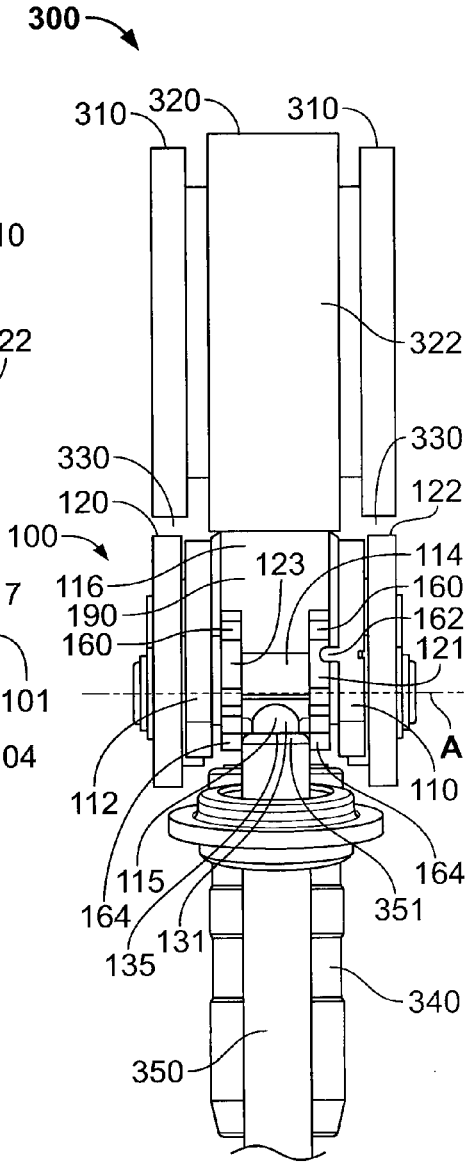
FIG. 4 illustrates a front view of deactivating rocker arm 100 in relation to a cam 300, lash adjuster 340 and valve stem 350.

FIGS. 3 and 4 illustrate a side view and front view, respectively, of rocker arm 100 in relation to cam 300 having lift lobe 320 with base circle 322 and lifting portion 324, and two circular "no-lift" or safety lobes 310 positioned above first and second safety lobe contacting surfaces 120, 122. Circular safety lobes 310 are concentric with base circle 322 of lift lobe 320, and have a smaller diameter than the diameter of base circle 322. It should be noted that the diameter of two safety lobes 310 need not be identical, need not be circular, and may have a diameter equal to or larger than the diameter of base circle 322. In such a scenario, first and second safety lobe contacting surfaces 120, 122 should be appropriately located such that they are spaced from safety lobes 310 under normal engine operation, but also come into contact with safety lobes 310 under certain abnormal engine conditions. As is clear from FIGS. 3 and 4, first and second safety lobe contacting surfaces 120, 122, when used in combination with circular safety lobes 310, do not transfer rotational motion of cam 300 to rocker arm 100. Alternatively, safety lobes 310 may be replaced with conventional lobes configured to transmit rotational motion of cam 300 to rocker arm 100 through surfaces 120, 122.

FIGS. 3 and 4 illustrate roller 116 in contact with lift lobe 320. A lash adjuster 340 engages rocker arm 100 adjacent its second end 103, and applies upward force to rocker arm 100, and in particular outer rocker arm 102, while mitigating against valve lash. Valve stem 350 engages pivot foot 115 adjacent first end 101 of rocker arm 100. In the activated state, rocker arm 100 periodically pushes valve stem 350 downward, which serves to open the corresponding valve (not shown). In the deactivated state, inner arm 108 undergoes lost motion movement relative to outer arm 102 about pivot axle 114. As shown in FIGS. 1 and 2, bearing axle 118 may be mounted in bearing axle apertures 260 of inner arm 108. In such a configuration, axle slots 126 of outer arm 102 accept bearing axle 118 and allow for lost motion movement of bearing axle 118 and by extension inner arm 108 when rocker arm 100 is in a deactivated state. "Lost motion" movement can be considered movement of rocker arm 100 in response to cam 300 that does not transmit rotating motion of cam 300 to the valve. In the illustrated embodiments, lost motion is exhibited by pivotal motion of inner arm 108 relative to outer arm 102 about pivot axle 114.

As shown in FIG. 4, clips 121, 123 have valve tip guides 164 that assist in maintaining proper alignment between valve tip 351 and pivot foot 115. Valve tip guides 164 extend radially outward from axis A farther than valve tip interfacing surface 135 of pivot foot 115, thereby extending along opposite sides of valve tip 351 as seen in FIG. 4. In the embodiment shown in FIG. 4, valve tip guides 164 prevent valve tip 351 from moving from side to side along A relative to pivot foot 115, which could result in pivot foot 115 becoming disengaged with valve tip 351.

Figure 5:
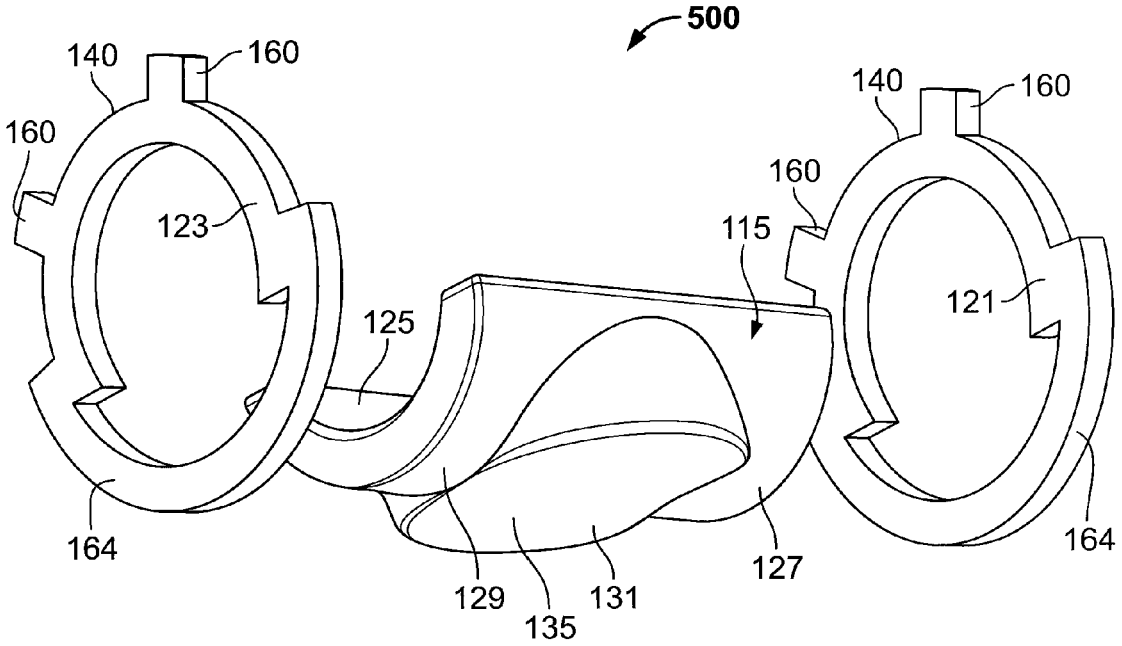
FIG. 5 illustrates an exploded view of pivot foot assembly 500.

FIG. 5 illustrates an exploded view of pivot foot assembly 500 comprising pivot foot 115 and clips 121, 123. When assembled, clips 121, 123 overlap first and second clip mounting portions 127, 129 of pivot foot 115, securing pivot foot 115 to axle 114. When rocker arm 100 is assembled, interfering protrusions 160 extending radially outward relative to longitudinal axis A of axle 114, as shown in FIGS. 1, 2, 4 and 5. Rotation of clips 121, 123 and pivot foot 115 about axle 114 in either available direction will result in interfering contact between interfering protrusion 160 and interfering projection 162, at which point further rotation in that direction is prevented. The amount of rotation pivot foot 115 and clips 121, 123 are permitted depends on the space between interfering protrusions 160. Between interfering protrusions 160 shown in FIG. 5 are projection gaps 140 that do not extend as far radially outward from axis A as interfering protrusions 160, thereby ensuring projection gaps 140 do not interfere with an interfering projection 162. When rocker arm 100 is assembled, interfering projection 162 is disposed adjacent a projection gap 140 and between interfering protrusions 160.

Prior to contact with valve stem 350, assembled pivot foot 115 and clips 121, 123 are rotatably secured to pivot axle 114, and their rotational motion limited as stated above by interference between interfering protrusions 160 and interfering projection 162. The limited range of rotational movement ensures pivot foot 115 is in a suitable location for assembly of rocker arm 100 into the engine (not shown), and in particular for assembly with valve tip 351. When engaged by valve stem 350, rotational movement of pivot foot 115 and clips 121, 123 is further limited. During normal engine operation, valve tip 351 may become momentarily disengaged with pivot foot 115, such as when upward momentum of the rocker arm 100 causes the rocker arm 100 to continue movement upward after the valve (not shown) is closed and the valve stem 350 and valve tip 351 have ceased moving upward. At such a point in time, the valve tip 351 may become disengaged with the valve tip interfacing surface 135. When the valve tip 351 and valve tip interfacing surface 135 become disengaged in this way, valve tip guides 164 assist in preventing excessive side to side movement of the valve tip 351 along direction A. Preventing such side to side movement, along with the restricted movement of pivot foot 115 due to clips 121, 123 and interfering projection 162, allows valve tip 351 to readily reengage pivot foot 115.

Figure 6:
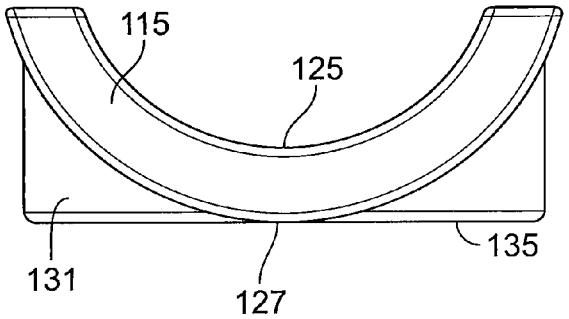
FIG. 6 illustrates a side view of pivot foot 115.

FIG. 6 illustrates a side view of pivot foot 115. As shown in FIG. 6, pivot foot 115 has a concave cylindrical axle interfacing surface 125. Valve tip interfacing surface 135 is illustrated as a flat surface, but may take other forms, such as a curved or indented surface.

Figure 7:
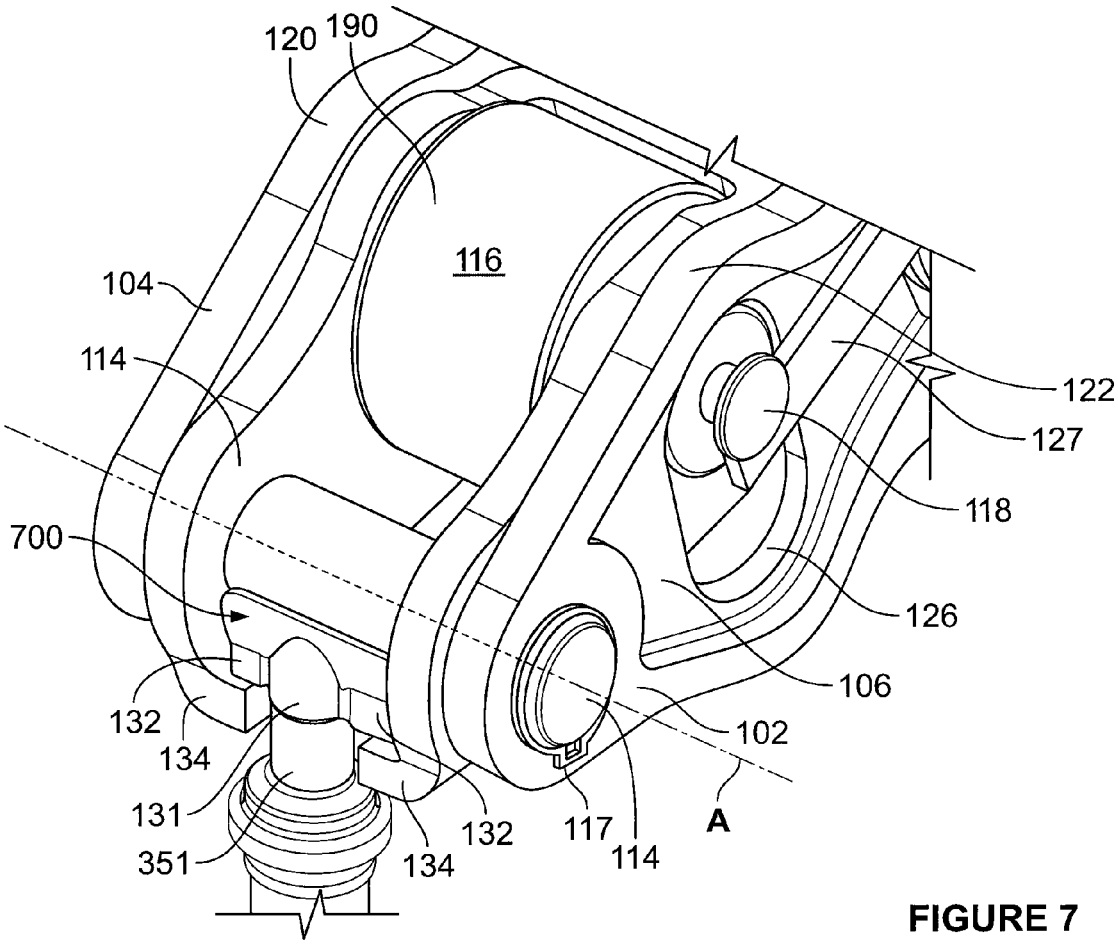
FIG. 7 illustrates a perspective view of an alternative embodiment of rocker arm 100 having a pivot foot 700.

FIG. 7 illustrates a partial perspective view of a rocker arm 100 having an alternative embodiment of pivot foot 700. The illustrated pivot foot 700 does not require clips 121, 123. Instead, pivot foot 700 has interfering blocks 132 that restrict movement of pivot foot 700 about axle 114 due to interfering tabs 134 extending from each of first and second inner side arms 110, 112 toward the opposing inner side arm. In this arrangement, pivot foot 700 is in a "loose-trapped" fit between the tabs 134 and axle 114. When interfering blocks 132 contact interfering tabs 134, movement of pivot foot 700 is restricted. Likewise, when the axle interfacing surface 125 contacts axle 114, the movement of the pivot foot 700 is limited to rotational movement about the axle 114, and then only to the extent the rotational motion is not prohibited by interference by interfering blocks 132 coming in contact with interfering tabs 134.

Figure 8:
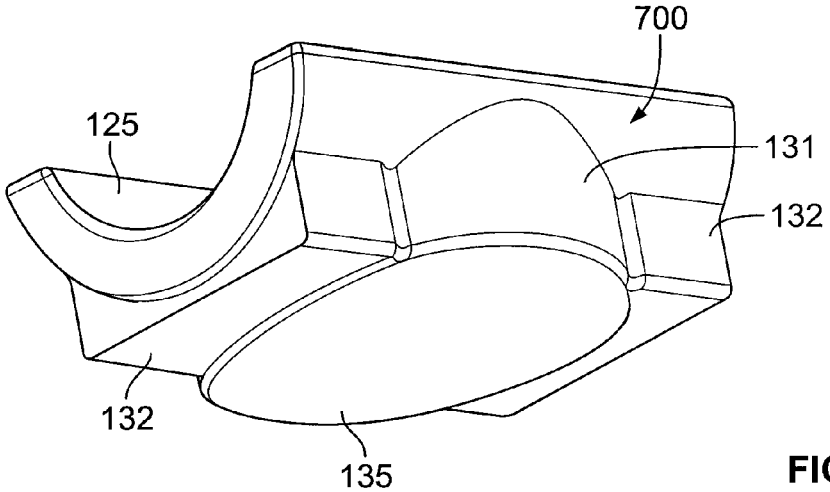
FIG. 8 is a perspective view of pivot foot 700.
Figure 9:
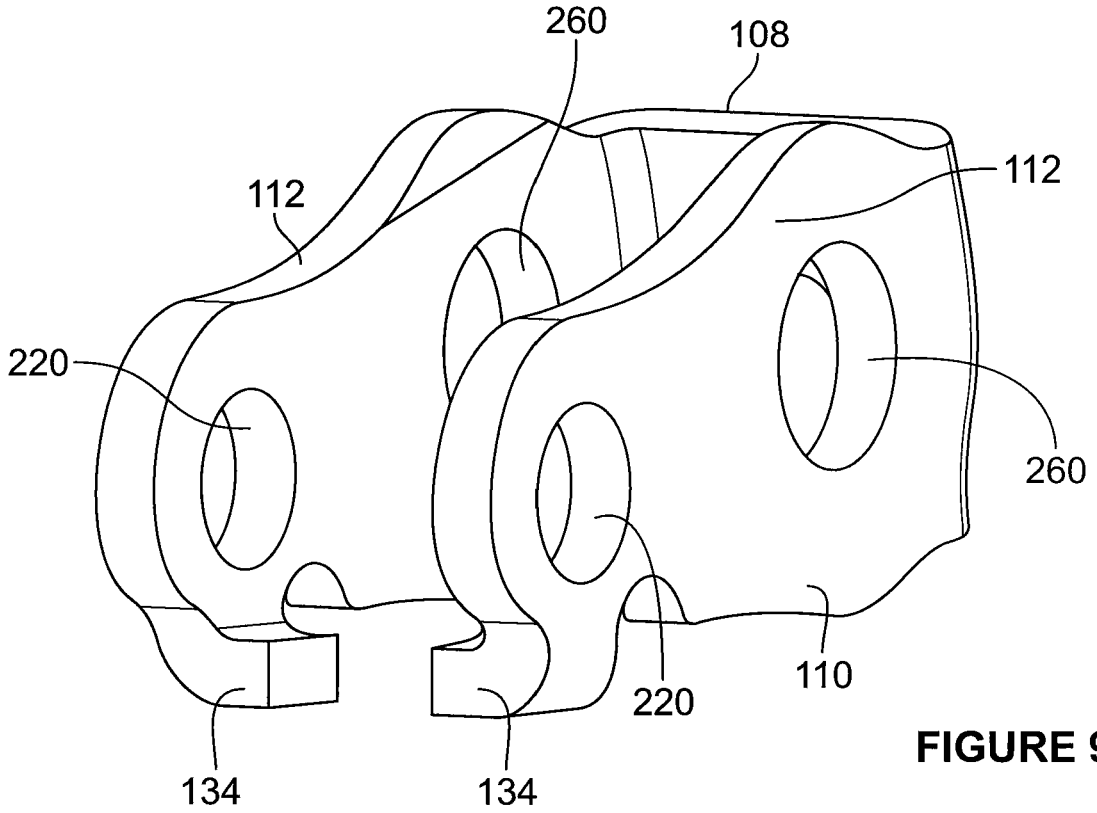
FIG. 9 is a perspective view of the inner arm 108.

FIG. 8 illustrates pivot foot 700 found in the embodiment shown in FIG. 7. Interfering blocks 132 are integral with pivot foot 700 and extend radially outward from axis A toward interfering tabs 134. Interfering tabs 134 are visible in FIG. 9, which shows a perspective view of inner body 108. When the alternative embodiment of rocker arm 100 is assembled, motion of pivot foot 700 will be restricted by interfering contact between axle interfacing surface 125 and axle 114, and between interfering tabs 134 and interfering blocks 132. This interfering contact prevents not only undesirable rotational motion about A, but also restricts pivot foot to remain approximately between axle 114 and interfering tabs 134 until assembly of rocker arm 100 with the engine (not shown).

When rocker arm 100 is assembled into position within an internal combustion engine (not shown), the restricted amount movement allowed pivot foot 700 as described herein ensures it will be in position to engage valve tip 351 without the need to manually adjust the position of pivot foot 700. When engaged by valve stem 350, movement of pivot foot 700 is further restricted, and axle interfacing surface 125 will contact axle 114. As stated previously, during normal engine operation, valve tip 351 may become momentarily disengaged from pivot foot 700. In the illustrated embodiment, interfering tabs 134 assist in preventing excessive side to side movement along direction A. This allows valve tip 351 to readily reengage pivot foot 700.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A dual body rocker arm comprising:

a first end, a second end, an outer arm, an inner arm, a substantially cylindrical pivot axle, a pivot foot, and a first and a second pivot foot retaining rings;

the outer arm having a first and a second outer side arms extending from the first end to the second end, and outer pivot axle apertures disposed adjacent the first end and configured for mounting the pivot axle;

the inner arm disposed between the first and second outer side arms and having a first and a second inner side arms, the first and second inner side arms having inner pivot axle apertures disposed adjacent the first end and configured for mounting the pivot axle;

the pivot axle disposed in the inner pivot axle apertures and the outer pivot axle apertures;

the pivot foot having (i) a cylindrical axle interfacing surface extending between the first and second inner side arms, (ii) a valve tip interface disposed between the first and second inner side arms, and (iii) a first and a second retaining ring mounting portions, the first retaining ring mounting portion disposed between the valve tip interface and the first inner side arm, and the second retaining ring mounting portion disposed between the valve tip interface and the second inner side arm; and wherein the first and second retaining rings overlap the corresponding first and second retaining ring mounting portions and partially rotatably mount the pivot foot to the pivot axle wherein the at least one of the first and second retaining rings has a first interfering protrusion configured to permit movement of the at least one of the first and second retaining rings relative to the inner arm until the first interfering protrusion contacts an interfering projection disposed on the inner arm.

2. The dual body rocker arm of claim 1 wherein at least one of the first and second retaining rings includes a second interfering protrusion separated from the first interfering protrusion by a projection gap.

3. The dual body rocker arm of claim 2, wherein the interfering projection extends from at least one of the first inner side arm toward the second inner side arm, or the second inner side arm toward the first inner side arm.

4. The dual body rocker arm of claim 3, wherein the interfering projection is disposed adjacent a projection gap of at least one of the retaining rings and is configured to limit rotational movement of at least one of the retaining rings about the pivot axle.

5. The dual body rocker arm of claim 1, wherein the retaining rings comprise guides extending further from a longitudinal axis of the pivot axle than a valve tip interfacing surface of the pivot foot.

6. The dual body rocker arm of claim 1, further comprising:

a first axle clip recess disposed adjacent a first end of the pivot axle, a second axle clip recess disposed adjacent a second end of the pivot axle; and an axle clip disposed within each of the first and second axle clip recesses.

7. The dual body rocker arm of claim 1 wherein the first and second retaining rings are fixed for rotation with the pivot foot.

8. A dual body rocker arm comprising:

a first end, a second end, an outer arm, an inner arm, a substantially cylindrical pivot axle, and a pivot foot;

the outer arm having a first and a second outer side arms extending from the first end to the second end, and outer pivot axle apertures disposed adjacent the first end and configured for mounting the pivot axle;

the inner arm disposed between the first and second outer side arms and having a first and a second inner side arm, the first and second inner side arms having inner pivot axle apertures disposed adjacent the first end and configured for mounting the pivot axle, the first inner side arm having a first interfering tab adjacent the first end and extending toward the second inner side arm, the second inner side arm having a second interfering tab adjacent the first end and extending toward the first inner side arm;

the pivot axle disposed in the inner pivot axle apertures and the outer pivot axle apertures;

the pivot foot having (i) a cylindrical axle interfacing surface, (ii) a valve tip interface, and (iii) at least one interfering block, wherein the at least one interfering block rotates with the pivot foot relative to the first and second interfering tabs and wherein contact of the at least one interfering block with one of the first and second interfering tabs restricts further relative movement of the pivot foot and the inner and outer side arms.

9. The dual body rocker arm of claim 8 wherein the at least one interfering block comprises first and second interfering blocks, the first interfering block disposed between the valve tip interface and the first inner side arm, the second interfering block disposed between the valve tip interface and the second inner side arm.

10. The dual body rocker arm of claim 8 wherein the at least one interfering block is configured to dispose the pivot foot approximately between the pivot axle and interfering tabs.

11. The dual body rocker arm of claim 8 wherein the interfering tabs are configured to restrict movement of a valve tip relative to the pivot foot.

12. The dual body rocker arm of claim 8, further comprising:

a first axle clip recess disposed adjacent a first end of the pivot axle, a second axle clip recess disposed adjacent a second end of the pivot axle;

an axle clip disposed within each of the first and second axle clip recesses.

13. The dual body rocker arm of claim 8 wherein the valve tip interface is disposed between the first and second inner side arms.

14. The dual body rocker arm of claim 8 wherein the at least one interfering block is disposed between the valve tip interface and one of the first inner side arm and the second inner side arm.

15. A dual body rocker arm comprising:

a first end, a second end, an outer arm, an inner arm, a substantially cylindrical pivot axle, and a pivot foot that rotates relative to the inner arm, the pivot foot having an axle interfacing surface, a block and a valve tip interface;

the outer arm having a first and a second outer side arms extending from the first end to the second end, and outer pivot axle apertures disposed adjacent the first end and configured for mounting the pivot axle;

the inner arm disposed between the first and second outer side arms and having a first and a second inner side arms, the first and second inner side arms having inner pivot axle apertures disposed adjacent the first end and configured for mounting the pivot axle;

the pivot axle disposed in the inner pivot axle apertures and the outer pivot axle apertures;

at least one interfering projection extending from at least one of the first inner side arm toward the second inner side arm, or the second inner side arm toward the first inner side arm; and at least one interfering tab extending from the first inner side arm toward the second inner side arm or the second inner side arm toward the first inner side arm wherein the block engages the at least one interfering tab upon rotation of the pivot foot relative to the inner arm causing further rotation of the pivot foot relative to the inner arm to be precluded.

16. The dual body rocker arm of claim 15 wherein:

the pivot foot comprises (i) a cylindrical axle interfacing surface and (ii) a valve tip interface.

17. The dual body rocker arm of claim 16 wherein the cylindrical axle interfacing surface extends between the first and second inner side arms.

18. The dual body rocker arm of claim 16 wherein the valve tip interface is disposed between the first and second inner side arms.

19. The dual body rocker arm of claim 15, further comprising:

a first axle clip recess disposed adjacent a first end of the pivot axle, and a second axle clip recess disposed adjacent a second end of the pivot axle.

20. The dual body rocker arm of claim 19, further comprising:

an axle clip disposed within each of the first and second axle clip recesses.

* * * * *